US011758998B2

(12) United States Patent
Keidel

(10) Patent No.: US 11,758,998 B2
(45) Date of Patent: Sep. 19, 2023

(54) ADJUSTABLE MOUNT FOR BACKPACK

(71) Applicant: Stephan Keidel, Hofheim (DE)

(72) Inventor: Stephan Keidel, Hofheim (DE)

(73) Assignee: SUDHAUS GMBH, Iserlohn (DE)

( * ) Notice: Subject to any disclaimer, the term of this patent is extended or adjusted under 35 U.S.C. 154(b) by 71 days.

(21) Appl. No.: 17/530,513

(22) Filed: Nov. 19, 2021

(65) Prior Publication Data

US 2022/0175118 A1 Jun. 9, 2022

(30) Foreign Application Priority Data

Dec. 7, 2020 (DE) ..... 102020132486.3

(51) Int. Cl.
*A45F 3/04* (2006.01)

(52) U.S. Cl.
CPC ..... *A45F 3/047* (2013.01)

(58) Field of Classification Search
CPC ..... A45F 2003/045; A45F 3/04; A45F 3/047; A45F 3/08; A45F 3/10
USPC ..... 224/201
See application file for complete search history.

(56) References Cited

U.S. PATENT DOCUMENTS 5,806,740 A * 9/1998 Carlson ..... A45F 3/047 224/259
7,232,048 B2 * 6/2007 Le Gal ..... A45F 3/08 224/634
11,445,806 B2 * 9/2022 Chen ..... A45F 3/047
2017/0102215 A1 * 4/2017 Castrati ..... A45F 3/14

FOREIGN PATENT DOCUMENTS

DE 202008017464 U1 * 1/2010 ..... A45F 3/047
DE 102014006194 A 11/2014
WO WO-2016207896 A1 * 12/2016 ..... A45C 13/30

* cited by examiner

*Primary Examiner* — Nathan J Newhouse
*Assistant Examiner* — Matthew T Theis
(74) *Attorney, Agent, or Firm* — Andrew Wilford

(57) ABSTRACT

An adjustable mount usable with backpack having a rear wall and shoulder straps has a base plate attached to the rear wall of the backpack, a cover on the base plate and forming therewith a housing, guide rails in the housing on the base plate and extending in an adjustment direction, and a slide in the housing and movable along the guide rails in the direction between end positions. A support plate outside the housing is attached to the shoulder straps and connected through the cover with the base plate for joint movement therewith in the direction. A control element coupled to the slide is movable between a locking position arresting the slide on the base plate and a release position allowing the slide to move steplessly in the direction on the rails relative to the base plate. The control element is accessible by a wearer of the backpack.

12 Claims, 3 Drawing Sheets

ADJUSTABLE MOUNT FOR BACKPACK

FIELD OF THE INVENTION

The present invention relates to a backpack, which here is intended to include a pack, knapsack, book bag or the like carried by straps on a wearer's back. More particularly this invention concerns a backpack with an adjustable mount.

BACKGROUND OF THE INVENTION

A backpack typically has shoulder straps that are attached to the outside of a back wall of the backpack, and an adjustable mount comprising a rectangular housing with a base plate and a cover both formed of a rigid material such as thin metal or plastic. The base plate carries longitudinal guide rails projecting into the housing and along which a displaceable and lockable slide is indirectly connected by a support plate to the shoulder straps and movable with the slide along the rail between two end positions or locked on the rail or the base plate. Adjustment and/or locking are effected by a control element movable between a locking position and a release position. The slide is movable inside the housing, and the support plate is outside on the cover connected through slots in the cover with the base plate.

Such backpacks are extremely popular in the state of the art. Usually two shoulder straps are used for putting on and carrying the backpack, for an ergonomic and comfortable carrying of the backpack or the book bag by a wearer. The two shoulder straps are connected together much closer to each other at their upper ends than at their lower ends on the backpack. Two downwardly open U-shaped strips of somewhat stiff construction may be connected only at one end to the support plate in the place of flexible strips connected at both ends thereto.

To ensure that the backpack can be carried comfortably and ergonomically there is often an adjustable mount for making possible a vertical-position adjustment of the shoulder straps with respect to the backpack. This vertical-position adjustment can change the positioning of the shoulder straps or the backpack connected to the shoulder straps according to the body size of the wearer.

An adjustable mount of this type is known for example in DE 10 2014 006 194. The vertical-position adjustment is done by actuating a control element that is a deformable spring locking element between a locking position and a release position. The locking position fixes the spring locking element slide on a rail in the locking position and in the release position the spring locking element oppositely releases it from the slide locking rail so that the pack is movable. Here, the vertical-position adjustment is effected by a control element on the outside, i.e. facing the back of the wearer on the adjustable mount.

In this prior-art system, the control element can be operated for example by a coin from the release position into the locking position and for movement to a desired vertical position and then oppositely into the locking position to fix it. However, this adjustment can only be done when the backpack is not on the back of the wearer, because access to the control element, which is located in or on the adjustable mount, in this carrying position would be against the back of the wearer. In practice, this means that to adjust the vertical position of the backpack, it must be removed from the back, then a vertical-position adjustment can be carried out and, after locking, the backpack must be put back on the back of the wearer. If, after putting back on the set position is not yet as desired, this process must be carried out again. This is time-consuming and hence undesirable procedure.

Such an adjustment of the vertical position can, for example, be necessary just when changing clothes such as to a thick jacket or the like.

OBJECTS OF THE INVENTION

It is therefore an object of the present invention to provide an improved adjustable mount for backback or BOOK BAG.

Another object is the provision of such an improved adjustable mount for backback or BOOK BAG that overcomes the above-given disadvantages, in particular that allows the adjustable mount to be operated the wearer while wearing the backpack.

A further object is to provide an improved adjustable mount that is of simple construction and inexpensive to manufacture, and that has a long service life.

SUMMARY OF THE INVENTION

An adjustable mount usable in combination with backpack having a rear wall and shoulder straps has a base plate attachable or attached to the outside of the rear wall of the backpack, a cover on the base plate and forming therewith a housing, guide rails in the housing on the base plate and extending in an adjustment direction, and a slide in the housing and movable along the guide rails in the direction between end positions. A support plate outside the housing is attached to the shoulder straps and connected through the cover with the base plate for joint movement therewith in the direction. A control element coupled to the slide is movable between a locking position arresting the slide on the base plate and a release position allowing the slide to move steplessly in the direction on the rails relative to the base plate. The control element is accessible by a wearer of the backpack while same is on a back of the wearer.

With such a device according to the invention the backpack can be adjusted with respect to its vertical position in the carrying position, that is when on the back of a wearer at any time as required. Should for example, a wearer notice that due to clothing the backpack is too high or too low even when in position on the back it is possible to adjust the vertical position and thus gain a significant increase in comfort for the wearer. The wearer is now no longer required as in the prior art known solutions to first take the backpack off his back, then adjust the vertical position, then lock in the new set position, and finally put the backpack back on.

This adjustment often takes place several times, since when on the back the vertical position needs adjustment so that the backpack in the position of use on the back of a wearer is in the optimal position. With this invention, at any time the vertical position can be adjusted also in this use position when the control element is actuated and thus a vertical-position adjustment is carried out as required.

In particular, it can particularly preferably be provided that near each transverse side edge of the housing floor there is a pocket or recess holding a respective ball-coupling drum. These ball-coupling drums are spanned by a ball chain with one stretch on the front of the housing floor between the two parallel longitudinal guide webs and the other stretch on the other side of the base plate and close to it. The ball chain is also positively connected to the slide for movement between the end positions, and at least one of the ball take-up drums is formed with a throughgoing hole for the control element that rotates this ball-coupling drum and thus adjusts the ball chain together with the slide. The rotatable control element is lockable in any position.

With such a solution according to the invention the one ball take-up drum is rotated by the control element so as to move the ball chain slide with the support plate along the adjustable mount between the end positions. This is done by the wearer simply turning the control element in the required rotational direction so that a vertical-position adjustment upward or downward takes place. When actuated by twisting the operating element by the wearer, the slide is moved with the support plate. For example, should a wearer of a backpack according to the invention want to change the location the backpack on his back, he would only have to turn the control element in the appropriate direction to adjust up or down. Once the wearer has set the desired altitude by turning the control element, he can use the control element in this position to lock and prevent undesired further movement.

It can particularly preferably be provided that connection be made by a square or polygonal throughgoing hole, in which a part of the control element with a complementary shape can be inserted or pushed through.

Such formation of the engagement of control element enables a particularly safe and durable power transmission from the control element to the ball take-up drum and thence to the ball chain with the slide and to the support plate attached to it. In addition, such a control element can in a particularly quick and easy way connect to the through holes according to the invention and to there be positively coupled for rotating the control element, ensuring power transmission and thus movement of the slide with the support plate.

Furthermore, it can particularly preferably be provided that the control element is biased against the force of a spring into the locked position.

This safely prevents any unwanted movement of the vertical position of the backpack when the control element is not actuated by the wearer against the force of the spring according to the invention and is blocked in the locking position. In practice this means that for adjustment the wearer must move the control element against the force of the spring from the locking position, for example by pulling, into an adjustment position. As soon as the wearer releases the control element, the control element is automatically activated by the spring to move into the locking position and thus effectively prevent undesired movement.

In addition, it can particularly preferably be provided that the control element is an actuation shaft with one end projecting laterally out of the housing of the adjustable mount and carrying an operating handle, while the other end of the actuation shaft opposite the actuation handle is square or polygonal and extends complementarily through the drum through hole and into a similarly shaped hole of a fixed stop so that when engaged therein it is blocked against rotation.

With such a control element according to the invention the wearer can, with the backpack on his back in the carrying position, adjust the vertical position of the backpack at any time by simply pulling the actuation handle of the control element projecting laterally from the adjustable mount. The operator only has to rotate the actuation handle in the desired direction to effect a vertical-position adjustment up or down according to the direction of rotation. According to the invention operation of the control element is intuitive and therefore also particularly simple for inexperienced wearers and at the same time provides a particularly high comfort feature. The wearer wanting to make a vertical-position adjustment of the backpack does not have to take it off his back and then adjust it and put it back on. A particularly fast and comfortable adjustment in the carrying position is therefore also possible when for example changing clothes, since an appropriate adjustment requires the vertical position of the backpack to be quickly and simply made possible.

It can particularly preferably be provided that the control element extends orthogonal to the direction of movement of the slide and the support plate. Such an arrangement of the control element is particularly easily reached and operated by the wearer of the backpack or the book bag, as it projects from the side of the adjustable mount and in this position is accessible at any time with the backpack on the back.

In addition, it can particularly preferably be provided that the ball-coupling drums are each formed by two frustoconical rings that together form a circumferential groove in turn formed with a row of uniformly spaced recesses that receive the balls and guide the ball chain. Such ball-coupling drums ensure safe and durable movement of the ball chain attached to the support plate of the slide and have a long service life. In addition, the groove and the angularly distributed recesses form a safe and accurate position guide for the ball chain and the balls of the ball chain.

In addition, it can particularly preferably be provided that the slide is formed approximately in the middle with a groove having a row of ball-receiving recesses extending approximately parallel to the longitudinal extension of the adjustable mount for connection to the ball chain, with the groove receiving the ball chain with the balls in the recesses.

Such a design of the slide provides optimal power transmission from the ball chain to the slide and therethrough indirectly to the support plate.

It can also be particularly preferably provided that the support plate is permanently connected to the shoulder straps, in particular sewn, screwed, riveted or glued.

Such an fixed connection of the support plate with the shoulder straps is a particularly durable solution and has proven itself in practice.

Furthermore, it can particularly preferably be provided that the slide can be releasably secured, for example by clips, to the support plate.

Also such a releasable connection of the slide with the support plate, which in practice is effected with clips, has proven itself and represents a cost-effective and long-lasting solution.

Finally, it can particularly preferably be provided that the back face of the backpack base plate carries a second cover part that covers the ball chain and has clamping and guide formations that contact and tension the ball chain longitudinally of the base plate of the housing.

Such a second cover part according to the invention protects the chain where it is on the back of the housing base plate and on the other hand creates a certain self-braking effect against unwanted movement, for when the control element is not in the locked position, for example in the event of a defect in the control element or the like. Pressure is thus applied through the second cover part on the ball chain and presses it against the back face of housing base plate. As a result, the ball chain is biased against the back of the base plate to generate some resistance to movement of the ball chain.

BRIEF DESCRIPTION OF THE DRAWING

The above and other objects, features, and advantages will become more readily apparent from the following description, reference being made to the accompanying drawing in which.

SPECIFIC DESCRIPTION OF THE INVENTION

Figure 2:
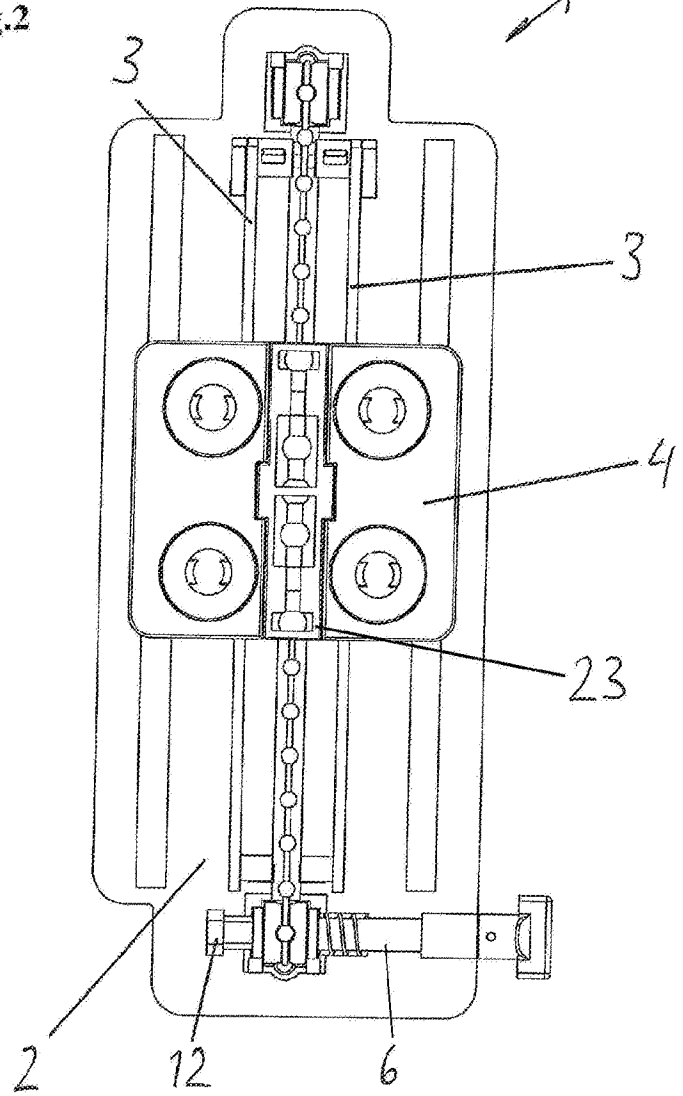
FIG. 2 is a view like FIG. 1 without the support plate.
Figure 1:
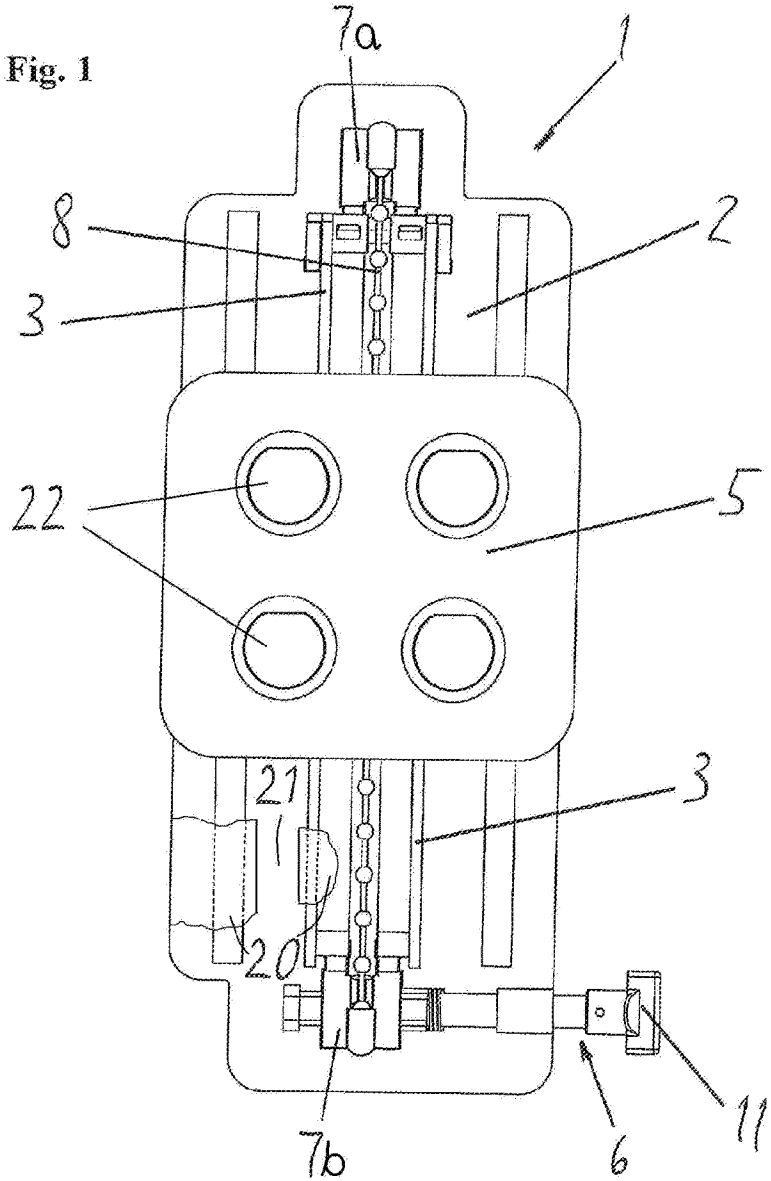
FIG. 1 is a front view of the inventive mount with a part of its cover.

As seen in the drawing an adjustable mount 1 carries a backpack 18 via shoulder straps 19 that are indirectly attached to the outside of the back wall of the backpack 18. The adjustable mount 1 has a rectangular housing with a base plate 2 and a cover plate 20 shown partially in FIG. 1. The base plate 2 of the adjustable mount 1 has vertical guide rails 3 extending longitudinally inside the housing. A slide 4 is movable along these rails 3 and lockable in any position thereto. The slide 4 is connected via removable clips 22 to a support plate 5 to which the shoulder straps 19 of the backpack 18 are secured. The support plate 5 moves together with the slide 4 along the rails 3 between two end positions. In addition, the slide 4 can be locked with the support plate 5 in the desired position so that unwanted movement is prevented. Here the adjustment and/or locking is effected by an operating element 6 rotatable between a blocking position and a release position.

The slide 4 is inside the housing formed by the base plat 2 and cover 20 and the support plate 5 is outside the housing cover 20, but connected therethrough via clips 22 riding in slots 21 of the cover plate 20.

The adjustable mount 1 here formed by the slide 4, the support plate 5 and the control element 6 is connected to the back wall of the backpack 18 and is operable from outside the backpack 18 when it is in position of use on the back of a wearer. In addition, according to the invention vertical-position adjustment of the support plate 5 and thus the shoulder straps 19 with respect to the adjustable mount 1 is stepless. In this solution, the adjustable mount 1 and its operating parts do not extend through holes in the back wall, so that entry of water or dirt is completely avoided.

Alternatively but not shown in the drawing, the adjustable mount 1 together with the slide 4 are also be inside or part of the back wall of the backpack 18 In this solution both the control element 6 and the support plate 5 extend through back wall and project out through such a backpack 18.

With such a backpack 18 according to the invention a vertical-position adjustment of the backpack 18 is possible in a particularly quick and easy way in the position of use, i.e. when the backpack 18 is on the back of the wearer. The backpack 18 can thus be adjusted for the current situation without the backpack 18 having to be taken off of the wearer.

Figure 4:
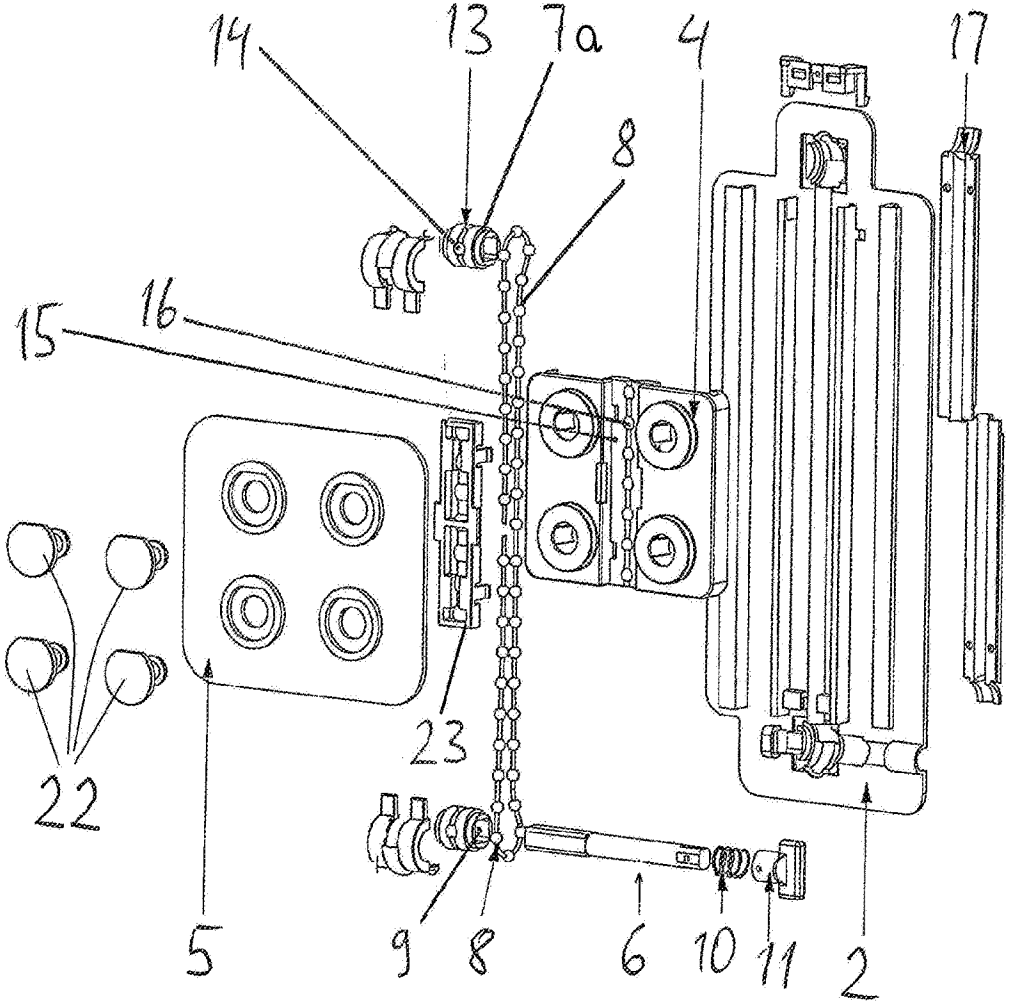
FIG. 4 is a front perspective exploded view of the mount.
Figure 3:
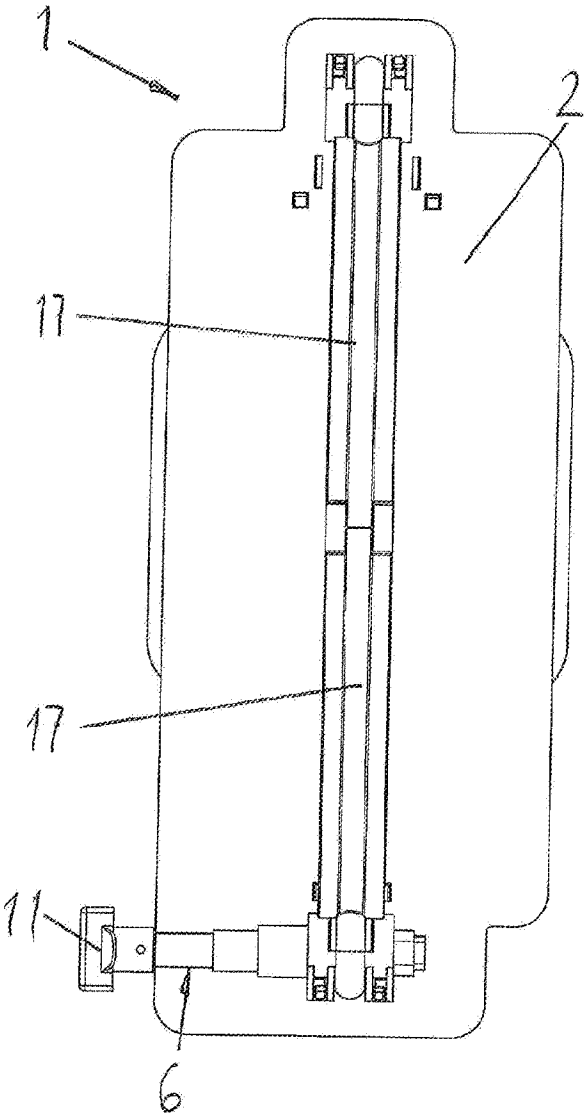
FIG. 3 is a back view of the mount.
Figure 5:
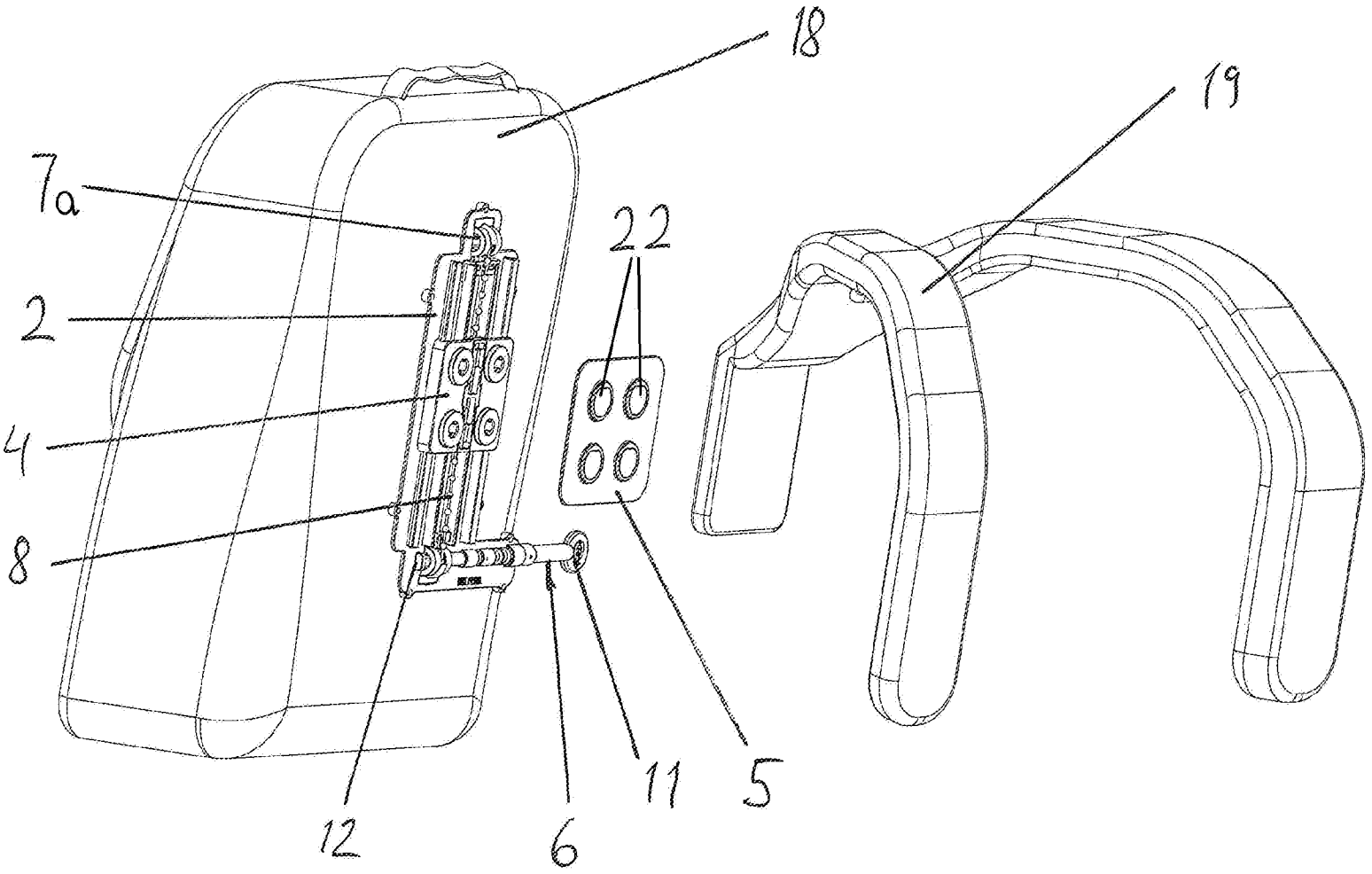
FIG. 5 is a small-scale exploded view of the mount and the associated backpack.

According to the invention as in particular shown in FIG. 4, near each of the short upper and lower end edges of the rectangular housing base plate 2 there is a part-cylindrical pocket or recess in which sits a respective cylindrical ball-coupling drum 7*a* or 7*b*. The two drums 7*a* and 7*b* are spanned by a ball chain 8. This ball chain 8 is on the front side of the base plate 2 between the two parallel and longitudinal guide rails 3 and close to the back of the base plate 2. The ball chain 8 is frictionally connected to the slide 4 and moves the slide 4 between its end positions. The lower ball-coupling drum 7*b* has a through hole for the control element 6. Thus, the operating element 6 can rotate the ball-coupling drum 7*b* to adjust the ball chain 8 to move the frictionally connected slide 4 between its end positions. After reaching the desired position, the control element 6 is lockable in this position. Alternatively and not shown in the figures, the through holes 9 can have other polygonal shapes.

In this embodiment a free end of the cylindrical shaft forming the control element 6 has a shape (here square) and size complementary to the through hole of the drum 7*b* it passes through. The operating element 6 is, as shown in particular in FIG. 4 biased by a spring 10 into the locked position. This ensures at all times that when the adjustable mount 1 or the operating element 6 of the adjustable mount 1 is not actuated, the operating element 6 remains in a locking position to prevent unwanted shifting of the backpack 18 and the shoulder straps 19.

According to the invention, the operating element 6 carries a handle 11 projecting laterally from the housing 2, 20 of the adjustable mount 1. This handle 11 can be operated by hand at any time, including in the use position in which the backpack 18 is on the back of a wearer, to adjust the vertical position of the backpack 18. As can also be seen in particular from FIG. 4, the actuation shaft on its free end opposite the actuation handle 11 is of a shape that is complementary to the square through hole 9 and fits through it.

On the side opposite the actuation handle 11 of the ball-coupling drum 7 the base plate 2 carries a square locking seat 12 in which the free end of the actuation shaft of the operating element 6 can fit while engaged in the complementary through hole 9 to be held against rotation. To adjust the operating element 6, the wearer must pull it slightly out of the locking seat 12 and then set the desired vertical position of the adjustable mount 1 by rotating it. This is followed by automatic locking of the control element 6 by the spring 10, which moves the operating element 6 back into the locking seat 12. This ensures at all times that the control element 6 is in the locked position and thus unwanted vertical-position adjustment is prevented.

For easier operation, the control element 6 extends orthogonal to the normally vertical direction of movement of the slide 4 and the support plate 5. This allows the wearer to reach particularly easily around the side of his body backward to the backpack 18 and there grab the laterally projecting handle 11 of the control element 6 of the adjustable mount 1 to operate it as desired.

According to the invention, the ball-coupling drums 7 each consist of two frustoconical rings forming a radially outwardly open groove 13 in turn formed with a row of part-spherical and radially outwardly open recesses 14. Both the groove 13 as well as the recesses 14 receive and guide the ball chain 8 and its balls.

In addition, the slide 4 is formed roughly centered on the slide 4 and thereby approximately parallel to the longitudinal extension of the adjustable mount 1 with a groove 15 in turn formed with a row of recesses 16 that together fit with ball chain 8 and its balls. This ensures particularly effective force transmission between the ball chain and the slide 4. A retaining element 23 engages over the chain 8 and holds it in the groove 15.

In a manner known per se, the support plate 5 is permanently connected to the shoulder straps 19, for example by sewing, screwing, riveting or gluing. The slide 4 can also be releasably connected, for example by clips, with the support plate 5.

As can be seen in particular from FIG. 4 according to the inventing the backpack 18 carries on the front face of the base plate 2 a second cover 17. The second cover part 17 fits over the front reach of the ball chain 8 to protect it from contact or for example from dirt. In addition, the cover part 17 has tensioning or guide formations that contact the ball chain 8 and tension or tighten it in the direction of the base plate 2. As a result, there is a certain restriction of its movement against an undesired movement of the ball chain 8, so that a certain force has to be applied to the ball chain 8 together with the slide 4 and the support plate 5 for adjustment.

The invention is not limited to the illustrated embodiment but variable within the framework of the disclosure. Everything disclosed in the description and/or drawing and combined features are considered essential to the invention.

I claim:

1. In combination with backpack having a rear wall and shoulder straps, an adjustable mount comprising:

a base plate attachable or attached to the rear wall of the backpack and formed with two seats spaced apart in an adjustment direction;

respective coupling drums rotatable in the seats;

a cover on the base plate and forming therewith a housing;

guide rails in the housing on the base plate and extending in the direction;

a slide in the housing and movable along the guide rails in the direction between end positions;

a support plate outside the housing, attached to the shoulder straps, and connected through the cover with the slide for joint movement therewith in the direction;

a control element coupled to the slide and movable between a locking position arresting the slide on the base plate and a release position allowing the slide to move steplessly in the direction on the rails relative to the base plate, the control element being accessible by a wearer of the backpack while same is on a back of the wearer;

a ball chain spanned over and rotationally coupling the drums and fixed to the slide for joint movement therewith in the direction, one of the drums being formed with a hole fitted with the control element for rotation of the one drum and thus displacement of the chain, slide, and support in the direction; and a formation on the base plate fittable with the coupling element for preventing rotation thereof and movement of the slide in the direction.

2. The combination according to claim 1, wherein the coupling element is a shaft at least partially of polygonal section and the hole is of complementary polygonal section and fits with the shaft.

3. The combination according to claim 2, further comprising:

a spring urging the control element into the locking position.

4. The combination according to claim 2, further comprising:

a handle accessible by the wearer while wearing the backpack on an outer end of the shaft, an inner end of the shaft being of the polygonal shape and fitting complementarily through the hole in the one drum and into the formation that is a polygonal-section seat opening coaxially to the shaft, the shaft being displaceable axially of its rotation axis between the locking and release positions.

5. The combination according to claim 4, wherein the axis extends orthogonal to the direction.

6. The combination according to claim 1, wherein the one drum is formed by two at least partially frustoconical rings forming a radially outwardly open groove in turn formed with angularly uniformly spaced and radially outwardly open recesses, the ball chain fitting complementarily with the groove and recesses.

7. The combination according to claim 1, wherein the slide is formed with a groove extending in the direction and formed with recesses uniformly spaced in the direction, the combination further comprising:

a retainer holding the ball chain in the groove and recesses of the slide and thereby coupling the slide to the ball chain.

8. The combination according to claim 1, wherein the support plate is permanently fixed to the shoulder straps.

9. The combination according to claim 1, further comprising:

at least one clip releasably attaching the shoulder straps to the slide.

10. The combination according to claim 1, further comprising:

another cover secured to a front face of the base plate and covering a stretch of the ball chain exposed on the front face.

11. The combination according to claim 10 wherein the other cover presses the stretch against the base plate and thereby frictionally brakes movement of the chain.

12. The combination according to claim 10, wherein the other cover pushes the drums apart in the direction and thereby tensions the ball chain between the drums.

* * * * *